US009284775B2

(12) United States Patent
Pimenov

(10) Patent No.: US 9,284,775 B2
(45) Date of Patent: Mar. 15, 2016

(54) SAFETY SYSTEM FOR MOVEABLE CLOSURES

(71) Applicant: Serguei Pimenov, Melbourne (AU)

(72) Inventor: Serguei Pimenov, Melbourne (AU)

(73) Assignee: AUTOMATIC TECHNOLOGY (AUSTRALIA) PTY LTD, Melbourne, Victoria (AU)

( * ) Notice: Subject to any disclaimer, the term of this patent is extended or adjusted under 35 U.S.C. 154(b) by 84 days.

(21) Appl. No.: 14/354,966

(22) PCT Filed: Oct. 31, 2012

(86) PCT No.: PCT/AU2012/001330

§ 371 (c)(1),
(2) Date: Apr. 29, 2014

(87) PCT Pub. No.: WO2013/063642

PCT Pub. Date: May 10, 2013

(65) Prior Publication Data

US 2014/0305599 A1 Oct. 16, 2014

(30) Foreign Application Priority Data

Oct. 31, 2011 (AU) ..... 2011904519

(51) Int. Cl.
*E05F 15/603* (2015.01)
*E06B 9/68* (2006.01)
(Continued)

(52) U.S. Cl.
CPC . *E06B 9/68* (2013.01); *E05F 15/43* (2015.01); *E05F 15/668* (2015.01); *E05F 15/77* (2015.01);
(Continued)

(58) Field of Classification Search
CPC ..... E06B 9/68; E05F 15/16
USPC ..... 318/16, 264–266, 272, 275, 277, 282, 318/286, 466–469, 626
See application file for complete search history.

(56) References Cited

U.S. PATENT DOCUMENTS 5,191,268 A * 3/1993 Duhame ..... F16P 3/14 318/266
5,412,297 A * 5/1995 Clark ..... E05F 15/668 318/266

(Continued)

FOREIGN PATENT DOCUMENTS

EP 1965009 9/2008
WO WO 2011/088514 7/2011

OTHER PUBLICATIONS

International Search Report prepared by the Australian Patent Office on Jan. 21, 2013, for International Application No. PCT/AU2012/001330.
Written Opinion prepared by the Australian Patent Office on Jan. 21, 2013, for International Application No. PCT/AU2012/001330.

*Primary Examiner* — Bentsu Ro
(74) *Attorney, Agent, or Firm* — Sheridan Ross P.C.

(57) ABSTRACT

The invention provides a closure system comprising an obstacle detection system for detecting objects in or near the path of a moving closure. The system comprises a remote module, a remote module timer, and a communication unit. The system further comprises a motor to drive the closure between open and closed positions, a controller for controlling operation of the motor, and a base station coupled to the controller for communication with the remote module and to transmit synchronization signals at first prescribed intervals. The remote module is arranged to have at least three modes of power usage: an operation mode, a standby mode, and a sleep mode. The system is further arranged such that, when in sleep mode, the remote module is configured to switch for a preset duration to said standby mode at or substantially at said first prescribed intervals to detect said synchronization signals so as to monitor the communications link between the base station and the remote module.

21 Claims, 6 Drawing Sheets

(51) Int. Cl.
*E05F 15/43* (2015.01)
*E05F 15/668* (2015.01)
*E05F 15/77* (2015.01)

(52) U.S. Cl.
CPC ..... *E05F 2015/436* (2015.01); *E05Y 2201/244* (2013.01); *E05Y 2400/40* (2013.01); *E05Y 2400/612* (2013.01); *E05Y 2400/66* (2013.01); *E05Y 2900/00* (2013.01); *E05Y 2900/106* (2013.01); *E06B 2009/6818* (2013.01)

(56) References Cited

U.S. PATENT DOCUMENTS

| | | | | |
|---|---|---|---|---|
| 5,493,812 | A | 2/1996 | Teich | |
| 7,123,144 | B2 | 10/2006 | Anderson et al. | |
| 7,518,326 | B2 * | 4/2009 | Shier | E06B 9/68 318/16 |
| 2009/0243839 | A1 | 10/2009 | Shier et al. | |

* cited by examiner

SAFETY SYSTEM FOR MOVEABLE CLOSURES

CROSS REFERENCE TO RELATED APPLICATIONS

This application is a national stage application under 35 U.S.C. 371 and claims the benefit of PCT Application No. PCT/AU2012/001330 having an international filing date of Oct. 31, 2012, which designated the United States, which PCT application claimed the benefit of Australian Application No. 2011904519 filed Oct. 31, 2011, the disclosures of each of which are incorporated herein by reference.

FIELD OF THE INVENTION

The present invention relates to a door or gate system and method of operating the same, more particularly to a safety system for moveable closures

BACKGROUND TO THE INVENTION

Motor powered operators for garage doors and the like are in wide use. Such systems generally work reliably and efficiently, however, they do raise the risk of injury or damage due to people or objects in the path of the closing door or gate. For this reason, it is common to fit safety means, which automatically monitor the resistance encountered by the moving closure (eg. by monitoring the speed of movement) and stop or reverse the travel if an unexpected resistance is encountered.

Further, a known safety measure is the inclusion of an infrared transmitter and receiver hard wired to the operator, positioned across the door opening and configured such that if an obstacle is detected between the transmitter and receiver, a signal is sent to the operator controller to stop or reverse the movement of the door. Generally, the transmitter and receiver are located near the bottom of the door tracks close to the ground. In some jurisdictions, the inclusion of such an obstacle detection device is required by the relevant regulations (such as those based on the UL Standard 325, which applies to residential garage door openers manufactured for sale in the United States).

Systems have been proposed in the past for wireless safety systems, such as that described in U.S. Pat. No. 5,493,812 to RMT Associates. A detection means, being an infrared transmitter/receiver system, having two states, a low power state (standby mode) insufficient to allow obstruction detection, and a high power state (operational mode) sufficient to allow obstruction detection. The system can switch from one state to the other in response to, for example, an acoustic or vibration signal transmitted over the garage door tracks, the signal indicating that the garage door is moving, and that the obstruction detection system must therefore switch into operation mode. When in operation mode, the door controller continuously monitors wireless approval signals sent from the obstruction detection system, until the door is open or closed or until an obstruction is detected.

One of the drawbacks of the system of U.S. Pat. No. 5,493,812 is that when in standby mode there is no communication at all between the obstruction detection system and the door controller. Audio frequency receivers continuously 'listen out' for the movement of the door in order to switch into operational mode. The use of an acoustic or vibration signal is prone to problems, as vibration or noise other than movement of the door may readily and frequently switch the obstruction detection system out of standby mode, thus defeating the objective of saving battery power. In addition, audio frequency monitoring in standby mode would use a significant amount of power. U.S. Pat. No. 5,493,812 mentions as a possible alternative the use of a radio frequency or infrared signal to wake up the obstruction detection system, but does not discuss how this may be accomplished. The document makes clear that such alternative methods are undesirable as they would require more energy in the dormant state, further contemplating that the audio/vibration detection approach may need to be partially self-powering, the frequency sensor being used to convert audio energy to electrical energy so to assist in powering the sensor.

In this specification, where a document, act or item of knowledge is referred to or discussed, this reference or discussion is not an admission that the document, act or item of knowledge or any combination thereof was at the priority date (a) part of common general knowledge, or (b) known to be relevant to an attempt to solve any problem with which this specification is concerned.

SUMMARY OF THE INVENTION

In accordance with one aspect of the invention, there is provided a closure system for a passageway or opening to be closed by a closure, comprising:

an obstacle detection system proximate to the passageway or opening, so to detect objects in or near the path of the closure during operation;

a remote module coupled to the obstacle detection system, the remote module having a remote module power source, a remote module timer; and a communication unit;

a motor arranged to drive the closure between open and dosed positions;

a controller coupled to the motor to control operation of the motor and therefore movement of the closure;

a base station coupled to the controller for communication with the remote module, the base station configured to transmit synchronisation signals at first prescribed intervals;

wherein the remote module is arranged to have at least three modes of power usage, an operation mode in which the obstacle detection system is activated, a standby mode in which the obstacle detection system is inactive and the communication unit is active, and a sleep mode in which the obstacle detection system is inactive and the communication unit is inactive;

and wherein, when in sleep mode, the remote module is configured to switch for a preset duration to said standby mode at or substantially at said first prescribed intervals to detect said synchronisation signals, thereby to monitor the communications link between the base station and the remote module.

Said synchronisation signals are preferably coded. They may contain data concerning the identity of the base station, and/or concerning the status of the controller. Said signals may be packetised digital signals.

Preferably, successive synchronisation signals are sent in accordance with a pseudo-random frequency hopping pattern. Said communication unit and said base station are therefore configured to support a frequency hopping communication protocol. Further, successive synchronisation signals may be sent in accordance with a pseudo-random code hopping pattern.

Preferably, said communication unit of the remote module supports two way communications between the base station and the remote module and is configured such that, if said remote module does not detect a synchronisation signal from the base station, a request signal is sent to the base station requesting re-transmission of a synchronisation signal. The base station will then send a further synchronisation signal to the remote module following receipt of the request signal. Once the synchronisation signal is received by the remote module, the remote module is configured to revert to sleep mode for substantially the remainder of the first prescribed interval.

Preferably, if no synchronisation signal is received within a set time period from sending said request signal, a further request signal is sent. Said request signal step may be repeated a prescribed number of times or until a prescribed time period has expired, and, if no synchronisation signal is received after such repeated request signals have been sent, the remote module commences a resynchronisation procedure to re-establish synchronised communication with the base station.

The timing controlling the switching of the remote module between sleep and standby modes is provided by the remote module timer. Preferably, the system is configured such that, if said remote module detects a synchronisation signal from the base station, the timing of the transmission is used to reset the timing of the remote module (eg. adjust the remote module timer).

Said remote module may be configured to transmit remote module check signals at second prescribed intervals, and said base station is configured to detect said remote module check signals at, or approximately at said second prescribed intervals and, if a remote module check signal is not received by the base station, the base station commences a resynchronisation procedure to re-establish communication with the remote module.

Preferably, the system is configured such that, when a remote module check signal is received by the base station, the base station transmits a confirmation signal, and if this confirmation signal is received by the remote module within a prescribed time period from the sending of the remote module check signal, the remote module switches to said sleep mode.

Said remote module check signals may be coded, and may contain information concerning the identity of the remote module. Successive synchronisation signals may be sent in accordance with a pseudo-random frequency hopping pattern.

Said resynchronisation procedure may involve a process which re-establishes timing of the remote module and which re-establishes a pseudo-random frequency hopping pattern stored at both the base station and the remote module.

Each of said first prescribed intervals may be one repeated time interval.

Each of said second prescribed intervals may be a multiple of said one repeated time interval.

Preferably, the communication between the communication unit of the remote module and the base station is radio frequency communication. Alternatively, it may be infrared communication.

The system is preferably configured such that, if the remote module receives a signal from the base station indicating a particular controller status, the remote module switches to said operation mode.

The obstacle detection system may include a photobeam system, breaking of the beam indicating detection of an object in or near the path of the closure. Breaking of the beam results in the remote module transmitting a signal to the base station to instruct the controller to take a prescribed action.

The photobeam system may comprise two transceiver modules, a first and a second transceiver module, each transceiver module including a power source to power a photobeam transceiver unit, and a transceiver module timer.

Preferably, the first and second transceiver modules are arranged in infrared communication with another.

A first transceiver module may be configured to have at least three modes of power usage, an operation mode in which a first photobeam is sent from the first photobeam transceiver unit and the obstacle detection system is thereby active, a standby mode in which the first photobeam transceiver unit can only receive signals, and a sleep mode in which the first photobeam transceiver unit is inactive.

Preferably, the first transceiver module is configured such that, when in sleep mode, it switches for prescribed time periods at prescribed intervals to said standby mode, in order to monitor photobeam check signals received from said second transceiver module.

Preferably, the photobeam check signals received from said second transceiver module are short burst photobeam check signals.

A second transceiver module may be configured to have at least three modes of power usage, an operation mode in which a second photobeam transceiver unit is able to receive a photobeam from the first photobeam transceiver unit, so to monitor for breaking of the beam, a standby mode in which the second photobeam transceiver unit can send photobeam signals, and a sleep mode in which the second photobeam transceiver unit is inactive.

Preferably, the photobeam signals sent from the second photobeam transceiver unit are short burst photobeam signals.

Said second transceiver module may be comprised in or connected to said remote module, so to switch to operation mode when said remote module switches to operation mode.

Said short burst photobeam signals may contain information instructing said first transceiver module to switch to operation mode, thereby to activate the obstacle detection system.

The first and second transceiver modules may be configured to transmit information concerning the status of their respective power sources.

According to a further form of the invention there is provided, in a wireless obstacle detection system for a closure to be closed by a motor-driven operator, a method including the following steps:

providing a remote module coupled to the obstacle detection system, the remote module having a remote module power source, a remote module timer, and a communication unit;

providing the remote module with at least three modes of power usage, an operation mode in which the obstacle detection system is activated, a standby mode in which the obstacle detection system is inactive and the communication unit is active, and a sleep mode in which the obstacle detection system is inactive and the communication unit is inactive;

providing a base station coupled to or included in the operator for wireless communication with the remote module;

transmitting wireless synchronisation signals from the base module at first prescribed intervals;

when the remote module is in sleep mode, switching it for a preset duration to said standby mode at or substantially at said first prescribed intervals to detect said wireless synchronisation signals, thereby to monitor the wireless communications link between the base station and the remote module.

Importantly, the invention removes the need for wires connecting the infrared beam system with the controller. Garage doors and other closures operate in what can be very tough environments, exposed to the extremes of outdoor environments, and wired devices are relatively vulnerable to such conditions. Moreover, wired devices require relatively costly and complex installation and maintenance, and give rise to significant inconveniences. Set against this is the fact that wireless devices require independent power sources. Keeping power consumption to a minimum is critical.

Further, the invention affords very high reliability against interference, whilst still keeping the power consumption requirements of the wireless elements (those having a battery power source) to a minimum.

BRIEF DESCRIPTION OF THE DRAWINGS

The invention will now be further described by way of non-limiting example with reference to the accompanying drawings, in which.

DETAILED DESCRIPTION OF THE DRAWINGS

Figure 1:
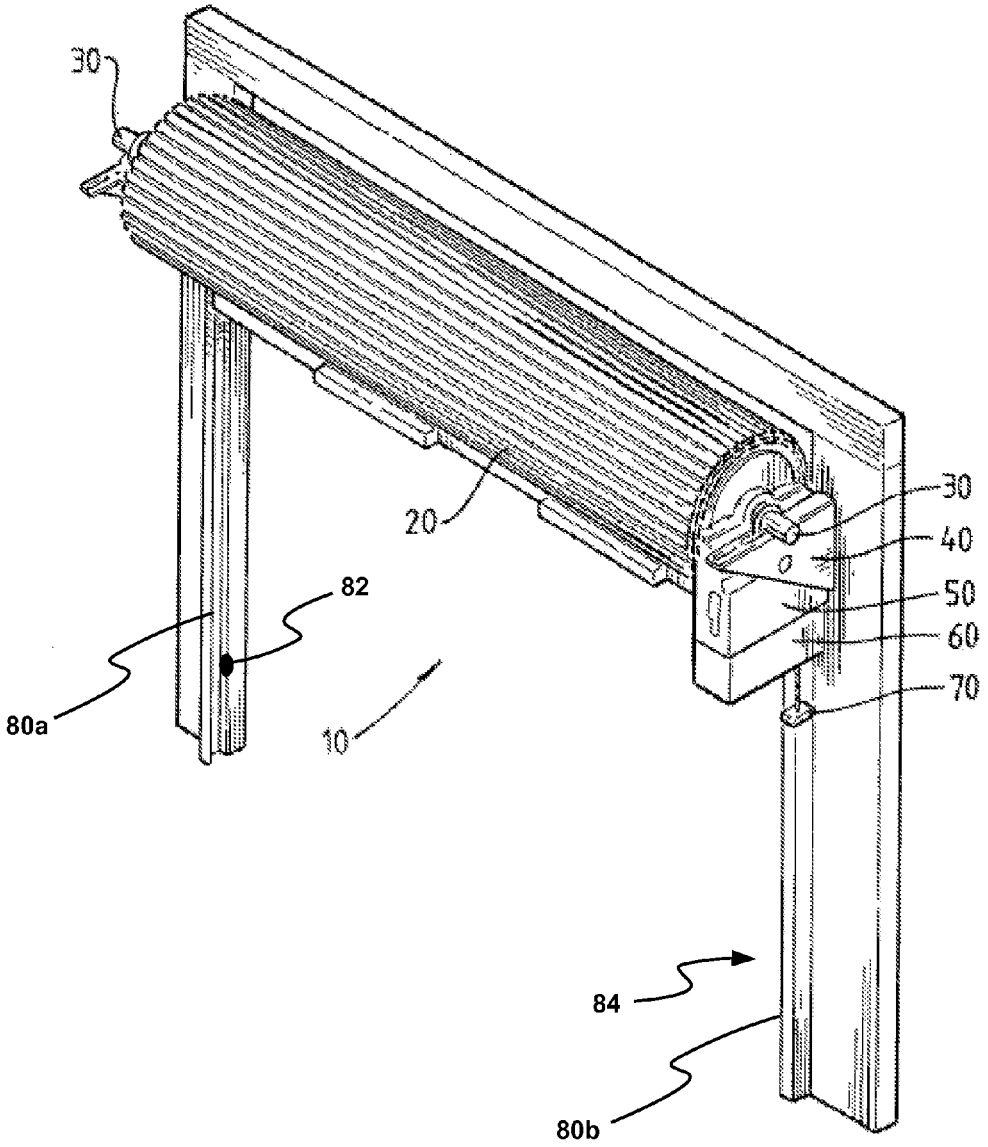
FIG. 1 illustrates an installed garage roller door system.

The roller door system 10 of FIG. 1 includes a drum-mounted roller door 20 on an axle 30 mounted to two end brackets 40. At one end of axle 30 is mounted an operator 50 including a stepping motor (not shown) and a drive train (not shown), as well as an electronic controller 60. Operator 50 is provided with a disengagement pull handle 70 for disengaging the drive train from roller door 20 if manual operation of the door is required at any time.

Although FIG. 1 shows a roller door system, it will be understood that the concept described herein is equally applicable to overhead doors (such as tracked tilt-up and sectional doors), shutters, curtains, gates or any other type of movable closure.

Controller 60 includes programmable microcircuitry to manage the various functions of the system, and includes or is coupled to a radio receiver for receiving radio control commands from a user's remote control transmitter device (not shown).

In or close to opposing tracks 80*a*,80*b* which guide the travel of door 20, there is provided an infrared beam (IR) transmitter/receiver system 82/84, arranged relatively close to (eg. 25-30 cm above) the floor, in order to detect obstacles positioned in the path of the closing door.

Figure 2:
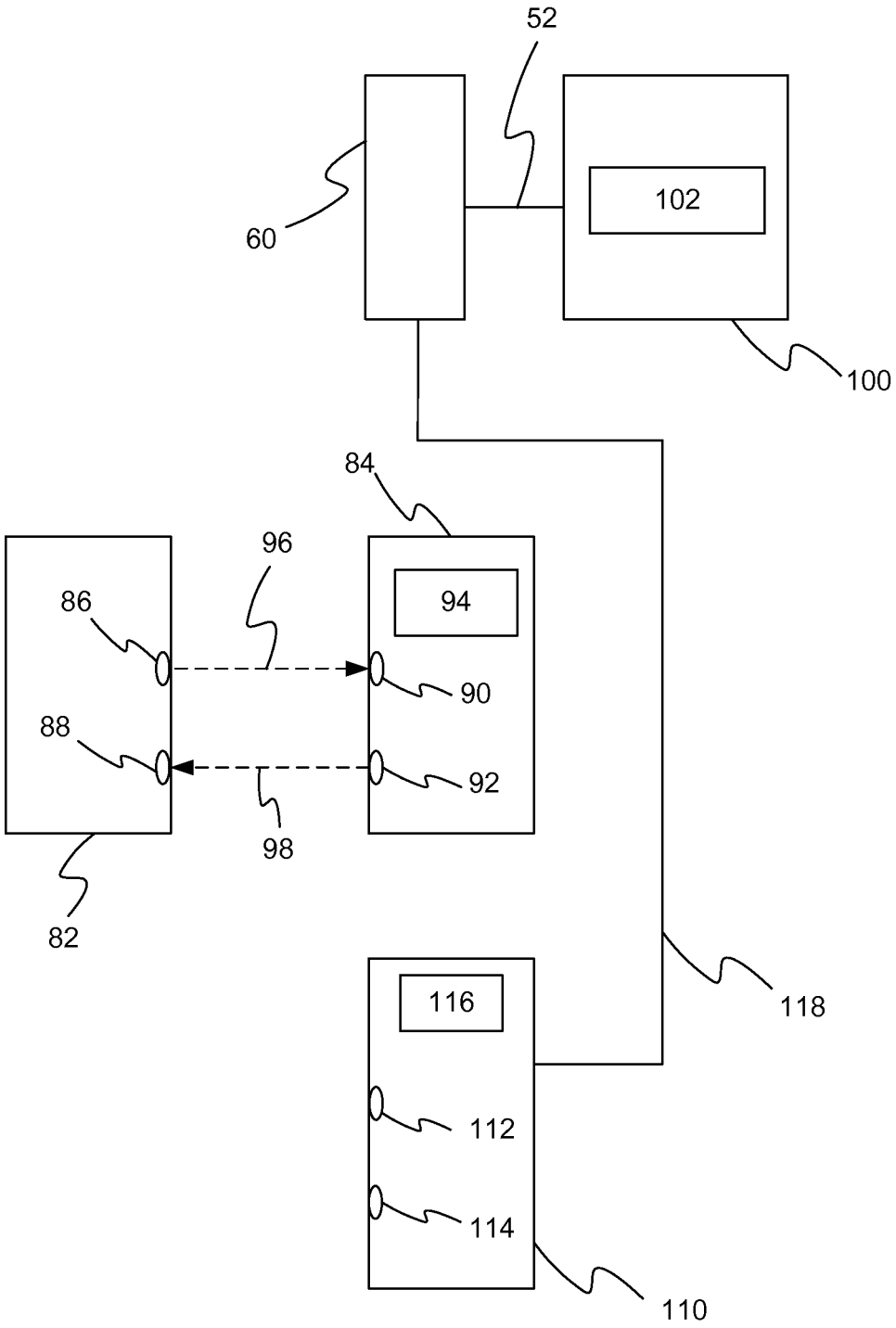
FIG. 2 shows a block diagram of a wireless infrared beam safety system.

FIG. 2 shows the components of the wireless IR beam safety system. A first IR transceiver module 82 comprises an IR beam emitter 86 and an IR detector in the form of a photoelectric cell 88, whilst a second IR transceiver module 84 comprises an IR detector (photoelectric cell) 90 and an IR beam emitter 92. IR transceiver module 84 further comprises an RF transceiver 94 with a PCB etched antenna, transceiver 94 including a microprocessor control. Both IR transceiver modules 82 and 84 include a battery or batteries to provide a power source (eg. 2×C batteries), and the operation of each photobeam is controlled by a microprocessor.

Door operator controller 60 is connected by lead 52 to a base station 100, which comprises an RF transceiver 102 with a PCB etched antenna and transceiver 102 including a microprocessor control. RF transceivers 94 and 102 are designed to communicate with one another by way of a selected communications technique. It will be understood that in an alternative embodiment, base station 100 may be integrated into door operator 50, and the microprocessor of RF transceiver 102 may be integrated into operator controller 60.

First and second IR transceiver modules 82 and 84 are arranged to communicate with each other over IR beams 96 and 98. In a manner understood by the skilled reader, in operation (eg. door closing) a signal is thus provided wirelessly to controller 60 if either IR beam 96/98 is broken, and the controller is programmed to take the appropriate action. Preferably, the controller 60 is configured such that, if it is closing, breaking of either IR beam 96/98 will cause it to stop, reverse and move door 20 to the fully open position, and await further instruction (see event 530 in FIG. 5). Additionally, in one embodiment, the controller 60 may be configured such that, if it is opening, breaking of either IR beam 96/98 causes it to stop, awaiting a further instruction.

In use, and as discussed in further detail below, when door 20 is not operating or is in the process of opening, the obstruction detector system remains in non-operational mode, so to minimise the power consumption of modules 82 and 84 and thus conserve battery life.

When door 20 begins closing (under command of the user's remote control), a suitable signal is relayed to transceiver module 84 via the RF link and an activation command is transmitted from IR emitter 92 to IR detector 88 encoded in IR beam 98, and the obstruction detector system is thus switched into operation mode. In operation mode, the IR emitter 92 sends IR pulses (of about 500 μs) of modulated IR signal to IR detector 88 every 10 ms. If such pulses are received the IR emitter 86 returns a similar pulse sequence (by way of IR beam 96) to IR detector 90. In this manner, the system knows that the photo beam is not broken. If this exchange signal is interrupted, a suitable signal is sent to base station transceiver 102 via the RF link to instruct controller 60 to halt and reverse the door travel. The IR module of transceiver module 84 goes into sleep mode, and transceiver module 82 goes into polling (listening) mode so as to listen for the 'wake up' signal from module 84. The skilled person would appreciate that arrangements could be realised in which the IR beam 96 is continuous.

If the battery voltage of transceiver module 82 drops below a prescribed level, a coded signal is sent by way of IR sensor beam 96 to transceiver module 84 which in turn relays a signal to base station transceiver 102, and an appropriate alert provided to the user at base station 100 or controller 60. Similarly, if the battery voltage of transceiver module 84 drops below a prescribed level, an appropriate signal is sent to base station transceiver 102, and again an appropriate alert is provided to the user at base station 100 or controller 60. The voltage of the batteries may be transmitted to the controller 60 whenever the obstruction detection system is switched into active mode.

Controller 60 is programmed such that, if an attempt is made to operate door 20 when there is no communication between base station transceiver 102 and IR transceiver module 84, the door will not operate, or at least will not close. Preferably, the controller 60 will be configured to take the same action as if the PE beam were detected to be broken while the door is in the process of closing, and simply travel to its fully open position if not already in that position.

It is important to minimise the obstacle detection response time (ie. the time between beam 96 being broken and controller 60 halting downward travel of the door), and this response time is designed to be 10 ms or less.

In order to minimise power consumption, transceiver module 84 is configured to have at least three modes of power usage, namely an operation mode in which the obstacle detection system is operational (ie. the IR transceiver modules 82/84 are active), a standby mode in which the obstacle detection system is inactive and RF transceiver 94 is active, and a sleep mode in which both the obstacle detection system (ie. IR transceiver modules 82/84) and RF transceiver 94 are inactive. In accordance with the invention (described in detail below), this is realised by the transmission of a short burst coded synchronisation signal (having an on-air duration of about 50 μs) in a suitable RF band from base station transceiver 102 at a regular interval (100 ms), and the switching on of RF transceiver 94 (ie. remote transceiver module 84 switching from the sleep mode into the standby mode) for a short period at that same interval in order to monitor that synchronisation signal. When that synchronisation signal is received, the wireless system is therefore assured that transceiver module 84 is in communication with the base station 100, and the microprocessor of RF transceiver 94 adjusts its internal clock data in accordance with the termination of the short burst synchronisation signal, to avoid any timing synchronisation drift relative to the internal clock of the microprocessor of the base station transceiver. RF transceiver 94 then switches off, toggling the wireless system back into sleep mode until the next scheduled transmission.

Having regard to the duration of signal transmissions used in the preferred embodiment, it will be appreciated that the effective timing of a signal transmission (Tx)/receipt (Rx) is about 400 μs. For signal receipt, this includes time for tuning the relevant transceiver to a specified frequency (taking about 130 μs). In addition, at least about 25 μs either side of a transmission may be incurred due to time shifting issues. Further time may be needed for longer signals. Similar issues apply with regard to signal transmissions which need to include additional time to account for the on-air duration of 50 μs (the duration generally used for all transmissions), plus other relevant provisions.

The operative interaction between the RF transceiver 94 and the base station 102 which brings effect to the power conservation process of the invention is described below with reference to FIGS. 3 and 4 which show respective logic algorithms (300 and 400 respectively) of the process.

Figure 3:
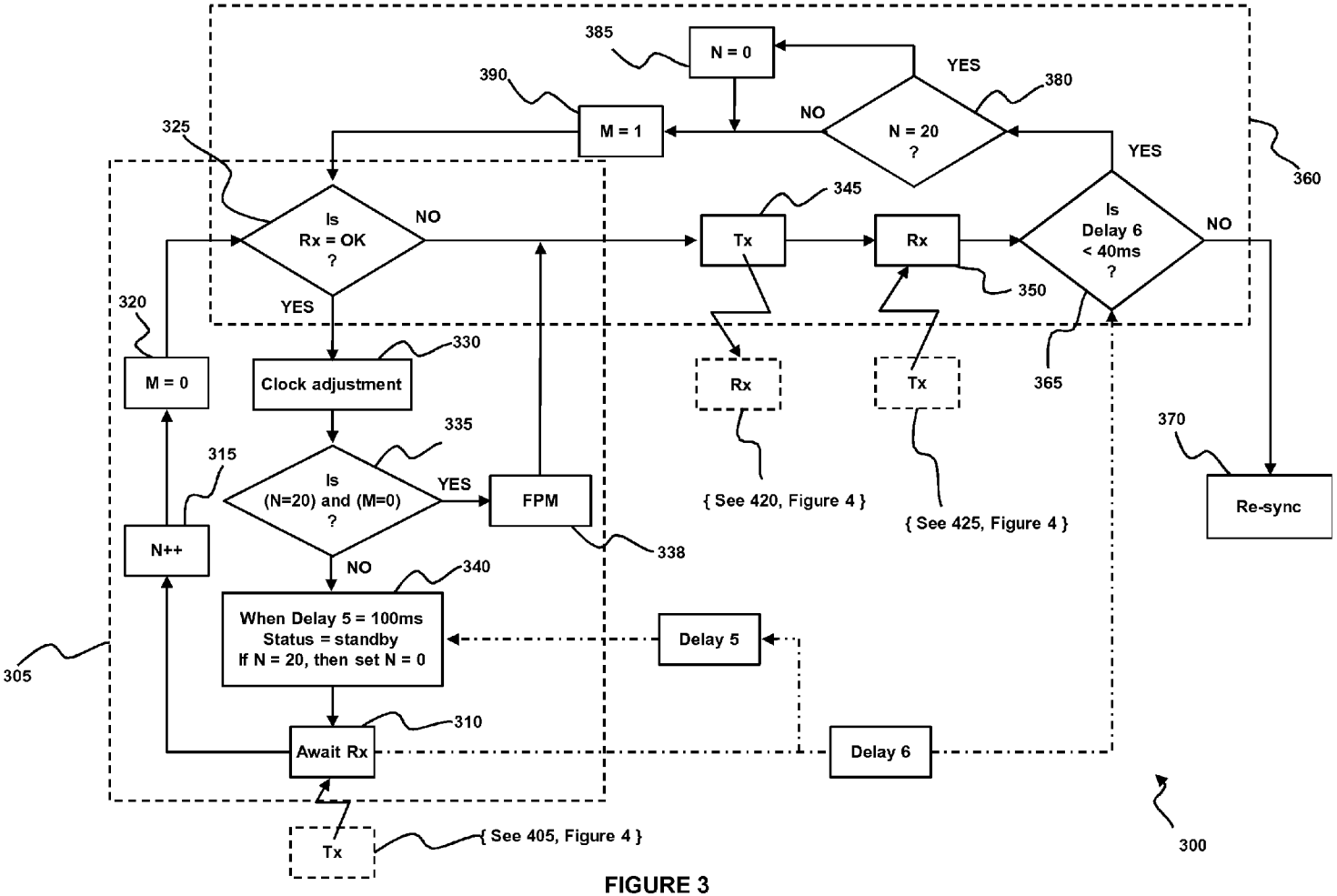
FIG. 3 shows a logic flow diagram diagrammatically representing the synchronisation process implemented for the wireless remote station.

FIG. 3 diagrammatically shows logic algorithm 300 implemented by RF transceiver 94 for carrying out the above described process. Algorithm 300 comprises two main sub-processes (305 and 360) which define core operating procedures of the RF transceiver 94 when in sleep mode. Sub process 305, represents the primary iterative synchronisation maintenance procedure carried out every 100 ms (referred to as 'Delay 5' in FIG. 3) between the base station transceiver 102 and RF transceiver 94, and sub-process 360 represents a protective resynchronisation procedure (referred to herein as 'forced protective mode', or FPM) executed following completion of a predefined number of iterations of sub-process 305 (eg. following completion of the 20th iteration of sub-process 305 triggered by 338), or as a default protective resynchronisation procedure when scheduled communications from the base station 100 are not timely received.

Sub-process 305 begins at event 310 where receipt of the short burst coded synchronisation signal transmitted from the base station 102 is monitored by RF transceiver module 94. Awaking for monitoring of the synchronisation signal commences a timer ('Delay 6' a time period of about 40 ms) and causes incremental adjustment of counter 'N' (315) and initialisation of a binary switch 'M' (320). In the present context, the skilled reader will appreciate that counter N represents a cycle counter which is increased incrementally once per iteration of sub-process 305, and binary switch M is used to control the desired direction of sub-process 305 in the event a synchronisation procedure was successfully completed on the 20th cycle (explained further below).

On successful receipt (310) of the coded synchronisation signal from the base station transceiver 102, assessment event 325 serves to validate the signal received and effectively confirm that the base station 100 and the transceiver module 84 are indeed synchronised. If favourable, the internal clock of RF transceiver 94 is adjust (330) so as to be in synchronisation with that of the base station 100 in accordance with the signal. If event 325 is unable to confirm receipt of the synchronisation signal, sub-process 360 is executed and active protective resynchronisation between the base station 100 and transceiver module 84 is sought (discussed below).

Once confirmation of synchronisation is completed, RF transceiver 94 tests to determine whether the current cycle is in the 20th iteration (ie. N=20) and whether a scheduled protective synchronisation test (see discussion on forced protective mode (FPM) below) has just been performed (ie. M=1). If assessment event 335 fails, the system toggles back into sleep mode (340) for the remainder of the current 100 ms interval before waking again ready to receive the next expected synchronisation signal from base station transceiver 102. If the current iteration will complete the 20th cycle, counter N will be reset to zero (event 340).

The coded synchronisation signal is a 64 bit sequence that contains data identifying the base station transceiver and the status of controller 60. In accordance with the status, this signal may cause the wireless system to switch into operation mode, if the status indicates that the door is closing or that a close signal has been received (see FIG. 5 and FIG. 6).

Successive synchronisation signals are sent in accordance with a quasi-random frequency hopping pattern known to both base station 100 and RF transceiver 94. Transmission in accordance with this pattern provides a constant guard against radio interference, thus minimising the chance of communication with the wireless system being lost. Such frequency hopping techniques per se are well known in the field of RF communication, and will not be further described here.

If, due to radio interference, no synchronisation signal is received by RF transceiver 94 at the due time, event 325 causes sub-process 360 to be executed. Here, transceiver 94 transmits (345) a RF signal to base station 100 requesting a further synchronisation signal be sent. This may be a brief (eg. 50 μs) coded signal, including information identifying the RF transceiver, and may be the same short burst coded signal initially sent at commencement of the cycle. If a synchronisation signal is then duly received by RF transceiver 94 (event 350), this confirms interference-free communication, sub-process 360 is exited and the internal clock data of transceiver module 84 is adjusted as explained above, and the wireless system completes sub-process 305 before switching back into sleep mode. If no synchronisation signal is received in response to the request signal 345, then a further request signal is sent by RF transceiver 94. This process is repeated until expiry of Delay 6. It will be appreciated that this criterion could also be implemented in terms of a maximum iteration count of cycles of sub-process 360. If no synchronisation signal is received by the end of this period (or number of prescribed iterations), this is deemed to indicate that synchronisation has been broken. At this point, base station transceiver 102 and RF transceiver 94 are programmed to commence a resynchronisation process (event 370), in order to re-establish synchronisation therebetween.

Resynchronisation (370) of wireless systems is generally known to the skilled reader, and will not be described in specific detail here. Importantly, resynchronisation involves the base station providing to the RF module data regarding timing and the frequency pattern to be employed for the frequency hopping. By way of brief explanation, the resynchronisation (370) process involves the base station 100 transmitting bursts of 8 RF pulses at the same frequency for about 400 μs, then listening for the following 200 μs. Each pulse has a specific byte so as to identify it. The frequency is changed for every consecutive burst in a random manner. The transceiver module 84 listens every 120 ms for about 200 μs at a random frequency. If the base station 100 and the transceiver module 84 frequencies coincide (ie. during the time the base station transmits and the transceiver module 84 is listening), the module 84 synchronises with the base station and sends a confirmation signal during the interval that the base station is listening.

Once resynchronisation has been successfully completed, the wireless system switches back into sleep mode to continue the cycle described above.

It will be understood that the technique described above provides an effective way to ensure communication between the base station 100 and the wireless system, whilst keeping power usage of the components of the wireless system to a minimum. However, it will be noted that in accordance with this algorithm, during periods other than in operation mode, the base station 100 may never receive signals from RF transceiver 94. Whilst this may indicate that the synchronisation signals are being duly received by the RF transceiver 94 and that all is well, there is a possibility that in fact communication has been lost due to interference or failure of the wireless system, or that synchronisation has been lost. For that reason, the system is configured to switch into a forced protective mode (FPM) every 20 synchronisation cycles (or other appropriate prescribed interval). Thus, on completion of the 20th iteration of sub-process 305, assessment event 335 will affirm thereby causing a FPM cycle (338) to commence.

A core component of the FPM mode 338 is thus sub-process 360. In this mode, RF transceiver 94 transmits (at event 345) a short burst coded FPM signal, while base station 100 is programmed to detect that FPM signal (events 415/420) at that time over a set period. If the FPM signal is detected (see affirmation of event 420 in FIG. 4), the base station 100 responds (at event 425 in FIG. 4) with a prescribed FPM confirmation signal. On receipt of this confirmation signal, the system knows (ie. by way of assessment event 325) that the communication link is open and synchronised, and the continuous synchronisation process is continued as described above.

In one form, the FPM cycle (338) is provoked by the RF transceiver 94 being programmed to wake up, on the 20th cycle, in time to miss the transmission (405) from the base station 100. As such, non-receipt of the transmission (determined at 325) provokes execution of sub-process 360 (ie. FPM mode). Alternatively, the base station 100 may be programmed to miss its regular transmission thereby provoking execution of sub-process 360.

As detailed above, if the FPM confirmation signal 350 is not received by the RF transceiver 94, assessment event 325 will fail causing a further short burst FPM signal to be sent to base station transceiver 102 for confirmation. Sub-process 360 repeats until the expiry of the prescribed time period (Delay 6) on repeated unsuccessful validation at assessment event 325 (measured from the time of the expected transmission by base station 100 at event 310)—at which point the system will automatically initiate a complete resynchronisation process (370).

Each iteration of sub-process 360 tests to determine at event 380 whether a scheduled FPM cycle is in progress (and has not been commenced following failure to receive the schedule synchronisation signal outside of the FPM procedure). If so, counter N is reset to zero (event 385), and binary switch M is set to unity. If assessment event 325 confirms successful receipt (at 350) of the confirmation signal from the base station 100, the internal clock of RF transceiver 94 will be adjusted accordingly and sub-process 305 will be allowed to continue. It will be understood that resetting counter N to zero (385) and equating binary switch M to unity (390) during sub-process 360 on the 20th cycle ensures that FPM is not recommenced when successfully re-entering sub-process 305 following completion of the scheduled FPM cycle.

Figure 4:
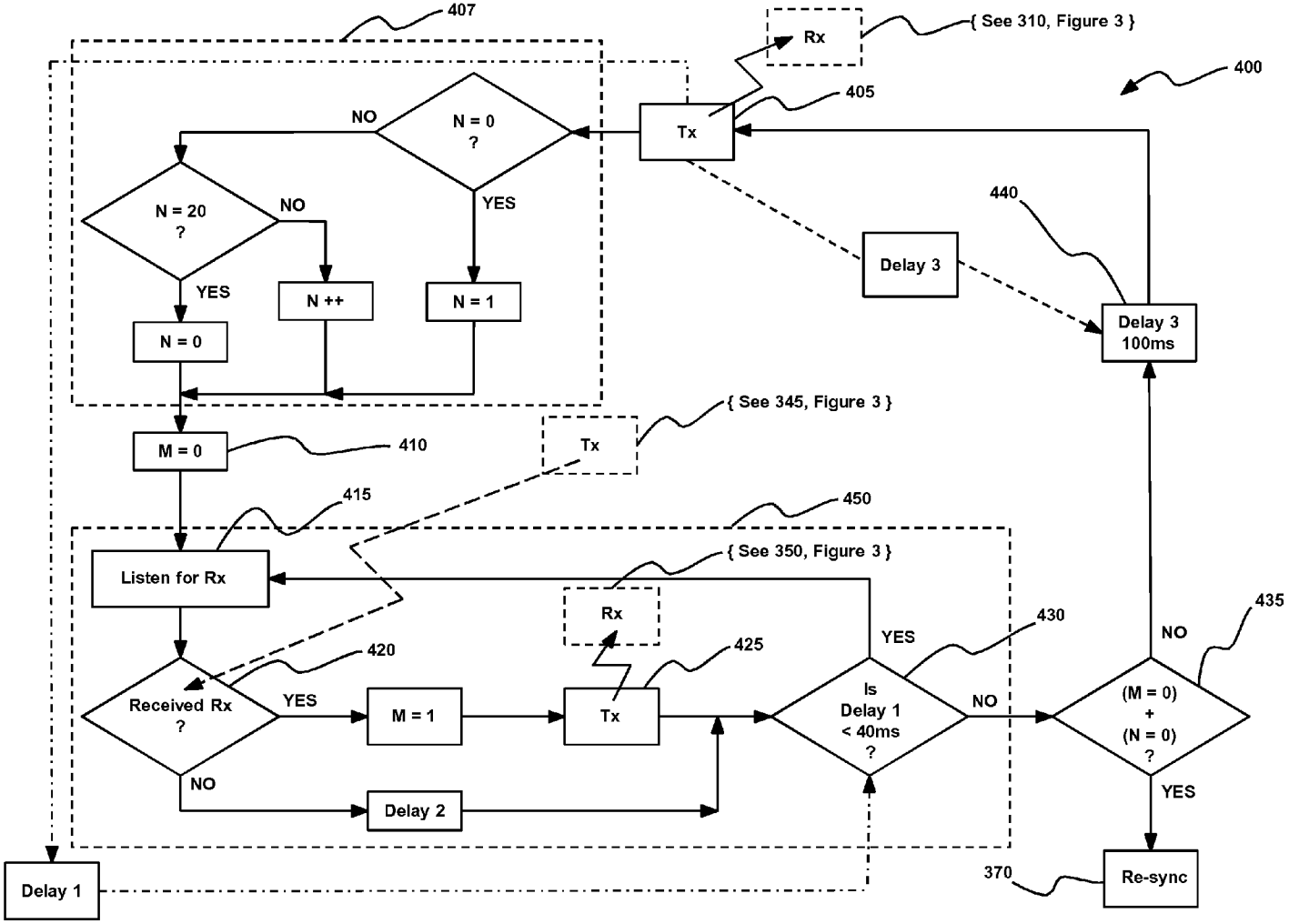
FIG. 4 shows a logic flow diagram diagrammatically representing the synchronisation process implemented for the wireless base station.

FIG. 4 shows the logic algorithm 400 which represents the process programmed into transceiver 102 of the wireless base station 100 every 100 ms ('Delay 3' in FIG. 4). Each synchronisation maintenance cycle begins with base station 100 transmitting the short burst coded synchronisation signal at event 405. Following transmission (405), sub-process 407 is entered which serves to test the current state of counter N to determine where in the synchronisation maintenance regime the current iteration is. It will be understood that the value of counter N and binary switch M dictates (at event 435) when the base station 100 is to revert to a full resynchronisation regime (event 370).

The base station listens (at event 415) for a request signal sent from the remote module 84. As discussed above, such a signal (see event 345 in FIG. 3) is expected every 20 polling cycles as part of the FPM cycle. Successful receipt of such a signal is tested for at event 420.

The base station 100 continues to listen (415) for the signal until the expiry of 40 ms ('Delay 1' in FIG. 4). Once expired, the base station 100 assumes synchronisation with the transceiver module 84 remains intact and prepares to repeat the transmission (405) as soon as Delay 3 expires. The latter described process typifies operation of base station 100 for a standard iteration of sub-process 305, ie. when N≠20. During these iterations, switch M remains zero signifying that the current cycle is a non-scheduled FPM cycle. Counter N, being non-zero during this time, causes event 435 to fail thereby allowing the process to proceed to the next polling cycle.

The above described process continues until the 20th cycle at which time a scheduled FPM cycle is executed by sub-process 305 (byway of event 338). As described above, during non-FPM cycles of sub-process 305, if synchronisation remains intact; no communication signal is received by the wireless base station 100 from the transceiver module 84. During an FPM cycle, assessment event 420 will confirm whether a communication signal from transceiver module 84 (at event 345 shown in FIG. 3) is received by base station 100. If receipt is confirmed, binary switch M is set to unity and the base station transceiver 102 transmits (at event 425) a confirmation signal to transceiver module 84 ('Delay 2' in FIG. 4). This signal is the same short burst coded synchronisation signal originally transmitted at event 405. If Delay 1 (about 40 ms) has not yet expired, events 415 and 420 are revisited but event 420 will fail given that transceiver module 84 has, following successful confirmation of receipt of the transmission (at event 350) at assessment event 325 (shown in FIG. 3), returned normally to complete the current iteration of sub-process 305. Thus, despite the wireless base station 100 continuing to iterate through sub-process 450 until the expiry of Delay 1, it will eventually proceed to assessment event 435 and fail (ie. M=1, N=20) so as to continue to the next cycle as normal.

If synchronisation is lost, this will be detected during a scheduled FPM cycle. Here, the synchronisation signal transmitted by the wireless base station 100 at event 425 will not be received by the transceiver module 84, and will provoke a further iteration of sub-process 360 to be performed by the RF remote transceiver 94. Continued requests will be made by the transceiver module 84 (at event 345), all of which will be received by the wireless base station 100 (ie. if no interference exists). Sub-processes 360 and 450 will both continue until respective Delays 6 and 1 expire (at events 365 and 430 respectively) at which point the transceiver module 84 will leave sub-process 360 and default to the programmed resynchronisation regime 370 (and so will cease sending signal requests). At this stage, counter N and binary switch M of process 400 will equal 20 and unity respectively, which will cause assessment event 435 to fail and provoke a further (and final) iteration of process 400 to commence. When sub-process 407 is next executed, sub-process 407 will test counter N and conclude that the 20th cycle is in progress so causing binary switch M to be set to zero (so setting both parameters to ensure that event 435 is affirmed). As the remote module 84 has by this time ceased transmission of any further request signals, assessment event 420 will fail (ensuring that M is not set to unity) and, on the expiry of Delay 1, cause affirmation of assessment event 435 thereby provoking the base station 100 to enter the programmed resynchronisation regime 370. The skilled reader will appreciate that sub-process 407 could be structured in a number of ways to ensure that counter N and binary switch M are adjusted appropriately to allow algorithms 300/400 to operate as described. For completeness of the above description of algorithms 300 and 400 shown in FIG. 3 and FIG. 4, Delay 1 and Delay 6 are equal, and relate to the protective loop of the forced protection mode (for example, 40 ms). Both Delay 3 and Delay 5 are equal and relate to the frequency of synchronisation maintenance (100 ms). Delay 2 is equal to the duration of the set transmission burst at event 425. It will be appreciated that the values of each delay could be readily varied depending on the desired system response requirements.

Figure 5:
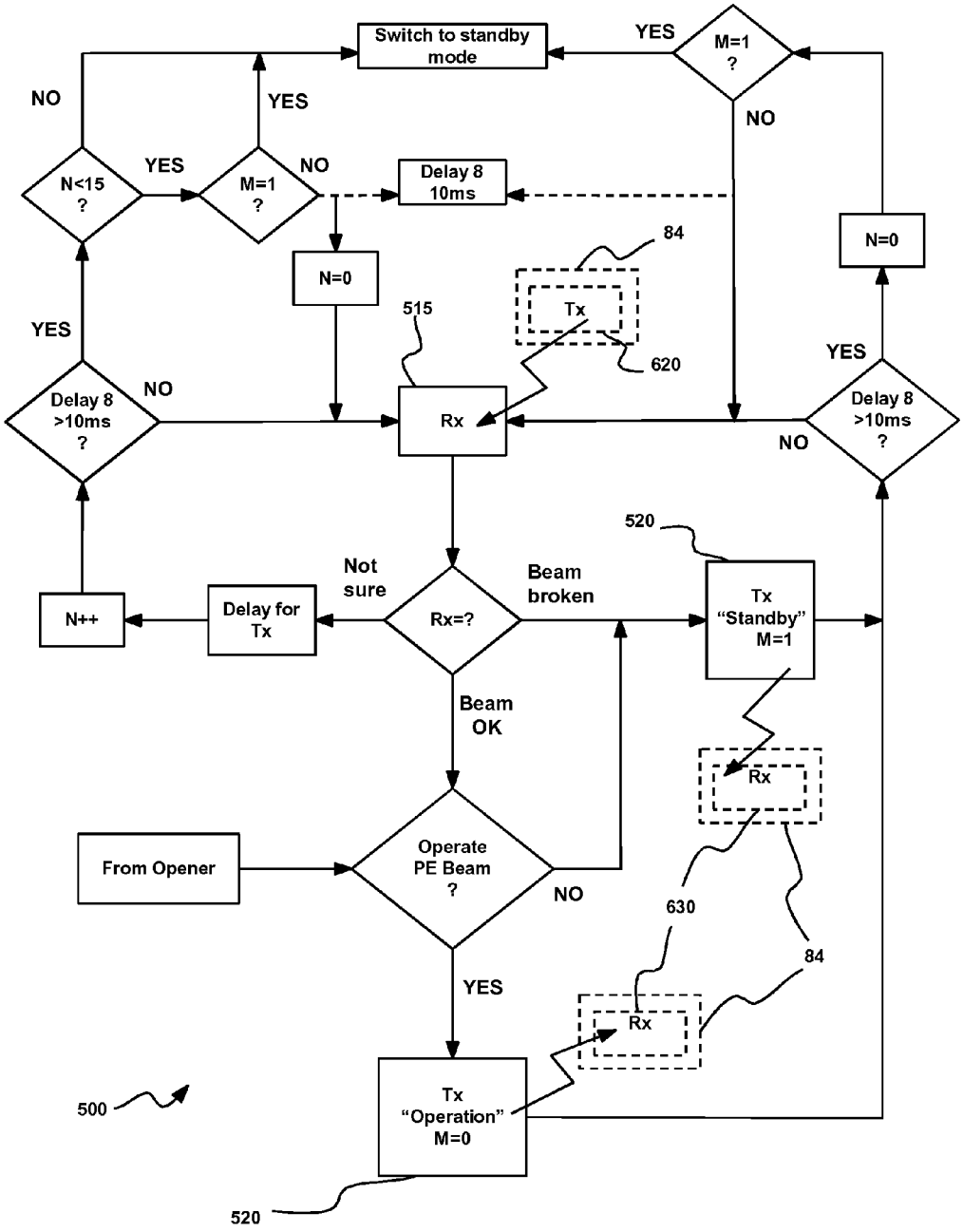
FIG. 5 shows a logic flow diagram diagrammatically representing one embodiment of the process implemented for the wireless base station when in operational mode.
Figure 6:
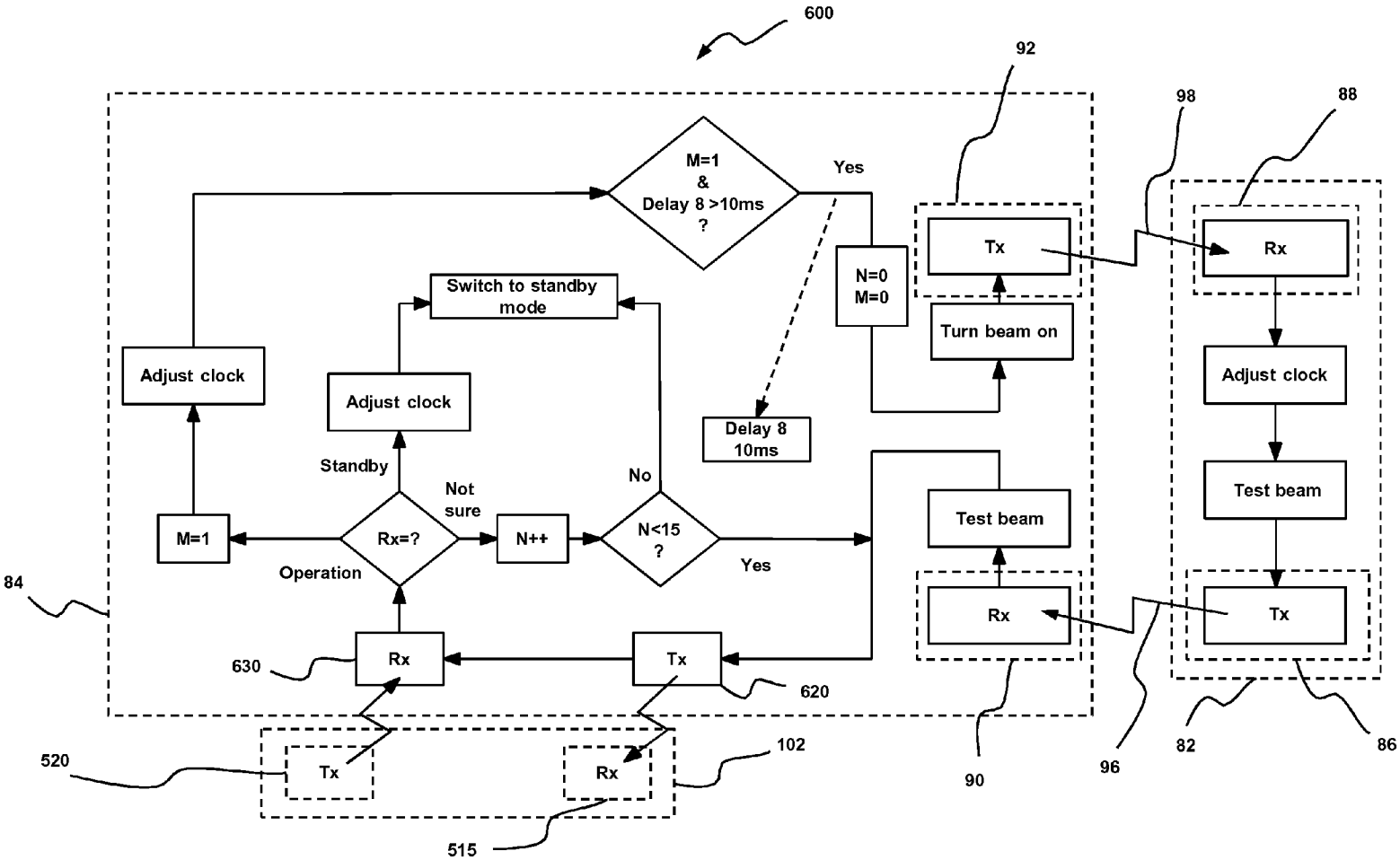
FIG. 6 shows a logic flow diagram diagrammatically representing one embodiment of the process implemented for the wireless remote station when in operational mode.

FIG. 5 and FIG. 6 show respective algorithms 500 and 600 which serve to demonstrate one implementation of the general interaction between the base station 100 and transceiver module 84 when the system switches to operational mode, eg. when a user instructs controller 60 to close the door. The transceiver module 84 checks the status of the PE beam, ie. whether the beam is broken or not. This status (beam 'OK' or beam 'broken') is then communicated (515/620) to the base station 100, receipt of which is confirmed by a return transmission (520/630). If the return transmission (520/630) fails, the process (515/620) repeats until (520/630) successful. Counter N in FIGS. 5 and 6 represents the number of unsuccessful attempts to pass the PE beam status to the base station 100—if N reaches 15 (which corresponds to Delay 8 of 10 ms), the system switches to standby mode. Correspondingly, if the base station 100 fails to receive (515/620) it does not send the confirmation transmission (520/630) thereby forcing the transceiver module 84 to repeat (515/620). Preferably, each transmission happens at the pseudo-random frequency pattern. This process repeats every 10 ms ('Delay 8') until either the opener interrupts it or the PE beam is determined to have been broken. In either event, the base station 100 and transceiver module 84 return to standby mode. If during operation mode the transceiver module 84 loses communication with the base station 100, the system will, after 15 attempts to re-establish communication, switch to standby mode. When in standby mode, the base station 100 and the transceiver module 84 will attempt to establish communication with one another. If this fails, the system will go into full resynchronisation mode (370).

In contrast to the operation of the system when in sleep mode, in which algorithms 300 and 400 are driven by the base station 100 transmitting its synchronisation signal (405) (and the transceiver module 84 listening passively therefor), in operational mode, it is the transceiver module 84 which actively transmits regular update signals to the base station reporting the status of the PE beam every 10 ms.

Turning to the synchronisation between the first and second IR transceiver modules 82 and 84, it will be appreciated that interference between these elements does not create a problem. Any interference would be indicative of an obstacle breaking the IR beam path. The first IR transceiver module 82 is programmed to switch from sleep mode to standby mode at regular intervals (eg. every 40 ms) for a short period (about 1.5 ms) to listen (poll) for a wake up signal pulse sent over link 98 from the second transceiver module 84. If no wake up signal is detected, it simply reverts to sleep mode. If a wake up signal is received, module 82 switches into operational mode, synchronising with the module 84 (ie. adjusting its internal clock data) by way of the end point of this pulse. Otherwise, during the wake-up period, transceiver module 82 polls transceiver module 84 for about 1.5 ms by way of IR beam 96. Thus, at regular intervals, transceiver module 82 wakes and listens for an awake signal, if any, before returning to sleep mode until the nest scheduled polling (listening) cycle.

With reference to FIG. 6, when in operational mode, IR beam 98 serves to test whether the beam is broken and to also operate as a synchronisation beam sent from transceiver module 84 which allows transceiver module 82 to synchronise its internal clock with transceiver module 84 (and indeed the internal clock of base station 100). Receipt of IR beam 98 by transceiver module 82 provokes transmission of IR beam 96 which serves to confirm receipt of the synchronisation signal sent by IR beam 98 and to transmit the current status of the PE beam. This cycle repeats every 10 ms as described above. If no signal is received by the base station 100 within the prescribed interval, the beam is considered broken or synchronisation lost and the appropriate action taken.

The system described above uses an RF connection to transceiver module 84, which in turn communicates with transceiver module 82 over IR link 98. However, it will be understood that in an alternative system in accordance with the present invention, RF communication may be provided between the base station 100 and both IR transceiver modules 82/84, in which case the intermittent monitoring across IR link 98 is not necessary.

As described above, the system is forced into forced protective mode (FPM) after each 20 cycles of 100 ms, in order to ensure that base station 100 does not lose contact with transceiver module 84. In protective mode, transceiver module 84 transmits a signal to be received by base station 100. If this signal is not received (despite repeated attempts via sub-process 360) within 40 ms (Delay 6), then the system has failed in protective mode and switches into resynchronisation mode (event 370).

It will be understood from the above that the wireless unit will be in its sleep mode for the majority of the time, hence minimising power usage as much as possible. This operation is effective because (a) the wireless base station and the wireless remote station are always within range of each other (unlike, for example, an RF remote control working with a vehicle or premises access control unit), and (b) the base station is mains powered, and hence its RF transceiver can be continuously monitoring for signals from the wireless remote station. Intermittent switching from sleep mode into a standby mode to monitor synchronisation signals from the base station provide continuous lower power synchronisation over the wireless link, thus assisting in minimising dangers of interference. For a test system developed by the present applicant in accordance with the invention, it has been calculated that under normal usage the system will afford a battery life of five years or more with transceiver modules 82/84 using 2×C type batteries.

Alternatively, the RF link between base station 100 and transceiver module 84 may be replaced by another form of wireless communication, such as an IR link. This reduces problems of interference, but requires line of sight communication, which may not be practicable in many situations.

It will also be understood that the IR beam system may be replaced by any other suitable system, such as a laser system. Additional, it will be understood that the system may include multiple IR beam systems, for example multiple beams at different heights relative to the door opening, or beams both inside and outside the door.

As shown in FIG. 2, the system may be provided with an optional wired receiver module 110 for installation in the event that there is unacceptably high RF interference at the installation location.

Wired receiver module 110 comprises an IR detector 112, an IR emitter 114, and a signal interface 116 that connects via a core interface link 118 to controller 60. Signals between controller 60 and receiver 110 therefore travel directly via link 118 rather than wirelessly between base station 100 and transceiver module 84, but otherwise the operation of this variant is identical to that described above.

The components used to construct the system should be well known to those in the art. The IR detectors used to date are TSOP 35238 units from Vishay®, however, other types may be used depending on anticipated light levels. Notably, units having reliable and accurate performance in high sunlight conditions would be preferable for use. The RF modules are Nordic NRF24LEI units and the PE beam comprises SPH 4545 infrared emitters from OSRAM.

The word 'comprising' and forms of the word 'comprising' as used in this description do not limit the invention claimed to exclude any variants or additions.

Modifications and improvements to the invention will be readily apparent to those skilled in the art. Such modifications and improvements are intended to be within the scope of this invention.

The claims defining the invention are as follows:

1. A closure system for a passageway or opening to be closed by a closure, comprising:

an obstacle detection system proximate to the passageway or opening, so to detect objects in or near the path of the closure during operation;

a remote module coupled to the obstacle detection system, the remote module having a remote module power source, a remote module timer, and a communication unit;

a motor arranged to drive the closure between open and closed positions;

a controller coupled to the motor to control operation of the motor and therefore movement of the closure;

a base station coupled to the controller for communication with the remote module, the base station configured to transmit synchronisation signals at first prescribed intervals;

wherein the remote module is arranged to have at least three modes of power usage, an operation mode in which the obstacle detection system is activated, a standby mode in which the obstacle detection system is inactive and the communication unit is active, and a sleep mode in which the obstacle detection system is inactive and the communication unit is inactive;

and wherein, when in sleep mode, the remote module is configured to switch for a preset duration to said standby mode at or substantially at said first prescribed intervals to detect said synchronisation signals, thereby to monitor the communications link between the base station and the remote module.

2. A closure system according to claim 1, wherein successive synchronisation signals are sent in accordance with a pseudo-random frequency hopping pattern.

3. A closure system according to claim 1, wherein the communication unit supports two way communications between the base station and the remote module and is configured such that, if said remote module does not detect a synchronisation signal from the base station, a request signal is sent to the base station requesting re-transmission of a synchronisation signal.

4. A closure system according to claim 3, configured such that, if no synchronisation signal is received within a set time period from sending said request signal, a further request signal is sent.

5. A closure system according to claim 3, wherein the request signal step may be repeated a prescribed number of times or until a prescribed time period expires, and, if no synchronisation signal is received after such repeated request signals have been sent, the remote module commences a resynchronisation procedure to re-establish synchronised communication with the base station.

6. A closure system according to claim 1, wherein the timing controlling the switching of the remote module between sleep and standby modes is provided by the remote module timer.

7. A closure system according to claim 1, wherein the system is configured such that, if the remote module detects a synchronisation signal from the base station, the timing of the transmission is used to adjust the timing of the remote module.

8. A closure system according to claim 1, wherein the remote module is configured to transmit remote module check signals at second prescribed intervals, and said base station is configured to detect said remote module check signals at or approximately at said second prescribed intervals and, if a remote module check signal is not received by the base station, the base station commences a resynchronisation procedure to re-establish communication with the remote module.

9. A closure system according to claim 8, wherein the system is configured such that, when a remote module check signal is received by the base station, the base station transmits a confirmation signal, and if this confirmation signal is received by the remote module within a prescribed time-period from the sending of the remote module check signal, the remote module switches to said sleep mode.

10. A closure system according to claim 8, wherein each of said first prescribed intervals is one repeated time interval, and each of said second prescribed intervals is a multiple of said one repeated time interval.

11. A closure system according to claim 1, wherein each of said first prescribed intervals are one repeated time interval.

12. A closure system according to claim 1, wherein the communication between the communication unit and the base station is one of radio frequency communication and infrared communication.

13. A closure system according to claim 1, wherein the system is configured such that, if the remote module receives a signal from the base station indicating a particular controller statue, the remote module switches to said operation mode.

14. A closure system according to claim 1, wherein the obstacle detection system includes a photobeam system, breaking of the beam indicating detection of an object in or near the path of the closure, and wherein breaking of the beam results in the remote module transmitting a signal to the base station to instruct the controller to take a prescribed action.

15. A closure system according to claim 14, wherein the photobeam system comprises two transceiver modules, a first and a second transceiver module, each including a power source to power a photobeam transceiver unit, and a transceiver module timer.

16. A closure system according to claim 15, wherein the first transceiver module is configured to have at least three modes of power usage, an operation mode in which a first photobeam is sent from a first photobeam transceiver unit and the obstacle detection system is thereby active, a standby mode in which the first photobeam transceiver unit can only receive signals, and a sleep mode in which the first photobeam transceiver unit is inactive.

17. A closure system according to claim 16, wherein the first transceiver module is configured such that, when in sleep mode, it switches for prescribed time periods at prescribed intervals to said standby mode, in order to monitor short burst photobeam check signals received from said second transceiver module.

18. A closure system according to claim 17, wherein the short burst photobeam signals contains information instructing said first transceiver module to switch to operation mode, thereby to activate the obstacle detection system.

19. A closure system according to claim 15, wherein the second transceiver module is configured to have at least three modes of power usage, an operation mode in which a second photobeam transceiver unit is able to receive a photobeam from the first photobeam transceiver unit, so to monitor for breaking of the beam, a standby mode in which the second photobeam transceiver unit can send short burst photobeam signals, and a sleep mode in which the second photobeam transceiver unit is inactive.

20. A closure system according to claim 15, wherein the second transceiver module is comprised in or connected to said remote module, so to switch to operation mode when said remote module switches to operation mode.

21. A closure system according to claim 15, wherein the first and second transceiver modules are configured to transmit information concerning the status of their respective power sources.

* * * * *